US006428354B1

(12) United States Patent
Meyer et al.

(10) Patent No.: US 6,428,354 B1
(45) Date of Patent: Aug. 6, 2002

(54) COAXIAL CONNECTOR FASTENING SYSTEM

(75) Inventors: Charles S. Meyer, Nevada City; Robert W. Hudelson; Daniel D. Reiswig, both of Grass Valley, all of CA (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 09/747,702

(22) Filed: Dec. 20, 2000

(51) Int. Cl.[7] ..... H01R 13/73
(52) U.S. Cl. ..... 439/551; 411/405; 411/919
(58) Field of Search ..... 439/550, 551; 411/405, 919, 402, 403, 404

(56) References Cited

U.S. PATENT DOCUMENTS 2,552,686 A * 5/1951 Melcher ..... 439/551
3,470,786 A * 10/1969 Martins ..... 411/405
4,616,535 A * 10/1986 Chiavon ..... 411/405

OTHER PUBLICATIONS

"BNC Receptacle", Model BCJ–FPL V01, No. BL057, Canare Corporation of America, 1 page (Aug. 16, 1993).

* cited by examiner

*Primary Examiner*—Tho D. Ta
(74) *Attorney, Agent, or Firm*—Merchant & Gould P.C.

(57) ABSTRACT

A coaxial connector assembly for mounting in an aperture in a stiff plate includes a barrel having a shoulder at its rear end for engaging an interior surface of the mounting plate and an external screw thread intermediate the front and rear ends of the barrel. A nut is fitted on the barrel from the forward end thereof and has an end face with a key formation for engagement by a driving tool.

5 Claims, 2 Drawing Sheets

COAXIAL CONNECTOR FASTENING SYSTEM

BACKGROUND OF THE INVENTION

This invention relates to a coaxial connector assembly.

Electronic signal processing and routing equipment, such as that used in the professional broadcast industry, requires a means for delivering signals to, and receiving signals from, the equipment. Typically, this requirement is met by signal connectors projecting from a back panel of the equipment, where cables provided with mating connectors can be engaged with the equipment connectors.

As the capability of electronic signal processing and routing equipment to handle multiple signals has increased, the desire to take advantage of that capability has led to an increase in the number of connectors projecting from the back panel of the equipment, such that the physical dimensions of the equipment can be dictated not by the bulk of the interior functional components of the equipment but by the need to have a back panel large enough to accommodate all the connectors that can be served by the interior functional components.

A connector that is commonly used in the professional broadcast and other industries is the BNC connector. The BNC connector is composed of a receptacle and a plug. The receptacle includes a ground conductor in the form of a hollow cylindrical barrel and a signal conductor that extends axially within the barrel. The barrel of the BNC receptacle is electrically connected to a ground plane conductor of a PCB backplane and the center conductor is electrically connected to a signal trace of the PCB backplane. The barrel has an axially outer portion with an external surface that is essentially smooth, except for bayonet pins that project from the smooth external surface in order to engage corresponding slots in a shroud of the BNC plug, and an axially inner portion provided with an eternal screw thread. The external diameter of the axially outer portion of the barrel is 9.5 mm. Typically, the plug includes a dielectric housing, and the external diameter of the housing places a lower limit on center-to-center spacing of receptacles in a field of receptacles. In practice, the lower limit is currently 0.625 inches (15.875 mm).

The back panel of electronic equipment normally includes a metal back plate overlying the PCB backplane. The metal plate is grounded and forms part of the EMI shielding for the equipment. Further, the metal plate is stiff and provides dimensional stability to the equipment's enclosure. Generally, the BNC receptacles are positioned so that the barrels extend through respective holes in the metal plate.

It is necessary that the BNC receptacle be attached firmly to the back panel of the equipment in order to ensure that the electrical connections to the PCB backplane, which are typically effected by soldering, will not be disrupted during normal use, which may involve applying axial, transverse and rotational forces to the barrel. In some cases, the receptacle can be soldered into the PCB backplane assembly with sufficient retention to provide a robust connection, in which case the barrel may extend loosely through the hole in the back plate. In other cases, it is not possible to provide a sufficiently robust soldered connection, and it is then necessary to retain the receptacle by clamping the back plate between an exterior flange of the receptacle on the inner side of the back plate and a separate fastening element, specifically a nut in threaded engagement with the barrel, on the outer side of the back plate. Hitherto, it has been conventional to employ a standard hexagonal nut for this purpose.

It is, however, difficult or impossible to install a standard hexagonal nut using a conventional socket or wrench, which engages flats at the periphery of the nut, when the barrels of the BNCs are at a center-to-center spacing as small as 0.625 inches because there is not sufficient space between adjacent nuts to accommodate the tool. Consequently, as a practical matter, use of BNC connectors at the minimum spacing has hitherto been confined to equipment in which the BNCs can be secured without a separate fastening element.

SUMMARY OF THE INVENTION

In accordance with the invention there is provided a coaxial connector assembly for mounting in an aperture in a stiff plate, said connector assembly including a barrel having a forward end for receiving a mating connector, a shoulder at a rear end for engaging an interior surface of the mounting plate, and an external screw thread intermediate the front and rear ends of the barrel, and a nut which can be fitted on the barrel from the forward end thereof and has an internal screw thread for threaded engagement with the external screw thread of the barrel, and wherein the nut has an end face with a key formation for engagement by a driving tool.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
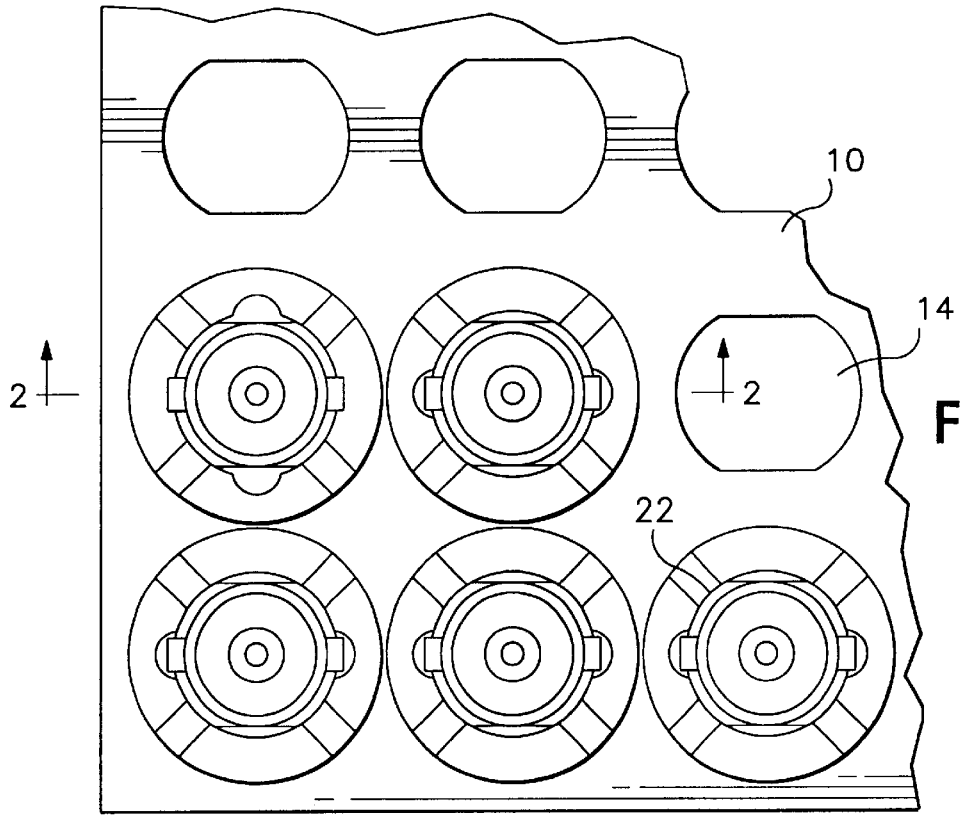
FIG. 1 is a partial elevation of the back panel of an item of electronic equipment provided with coaxial connector assemblies in accordance with the present invention.
Figure 3:
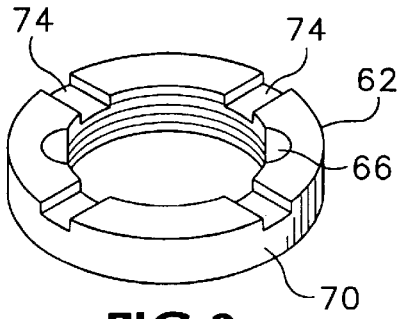
FIG. 3 is a perspective view of a retaining nut that forms part of the connector assembly.
Figure 4:
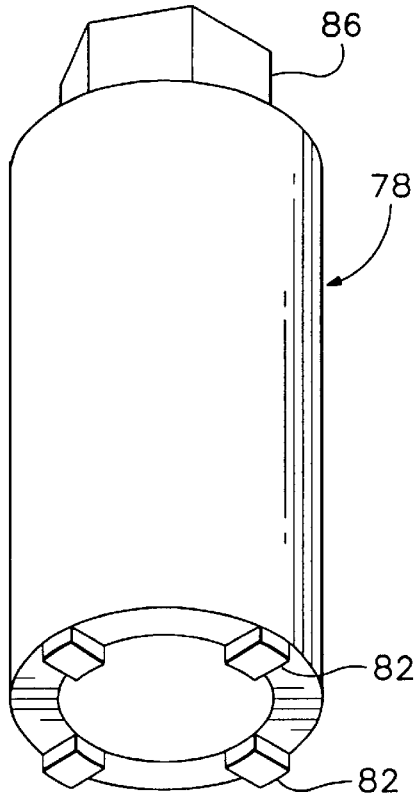
FIG. 4 is a perspective view of a tool used for installing the retaining nut.

FIG. 1 illustrates the back plate 10 of an item of electronic equipment. The back plate is made of metal and serves as part of the EMI shielding for the functional components of the equipment. The back plate 10 is formed with a rectangular array of openings 14. A PCB backplane 18 (not shown in FIG. 1) is located inward of the back plate 10.

Figure 2:
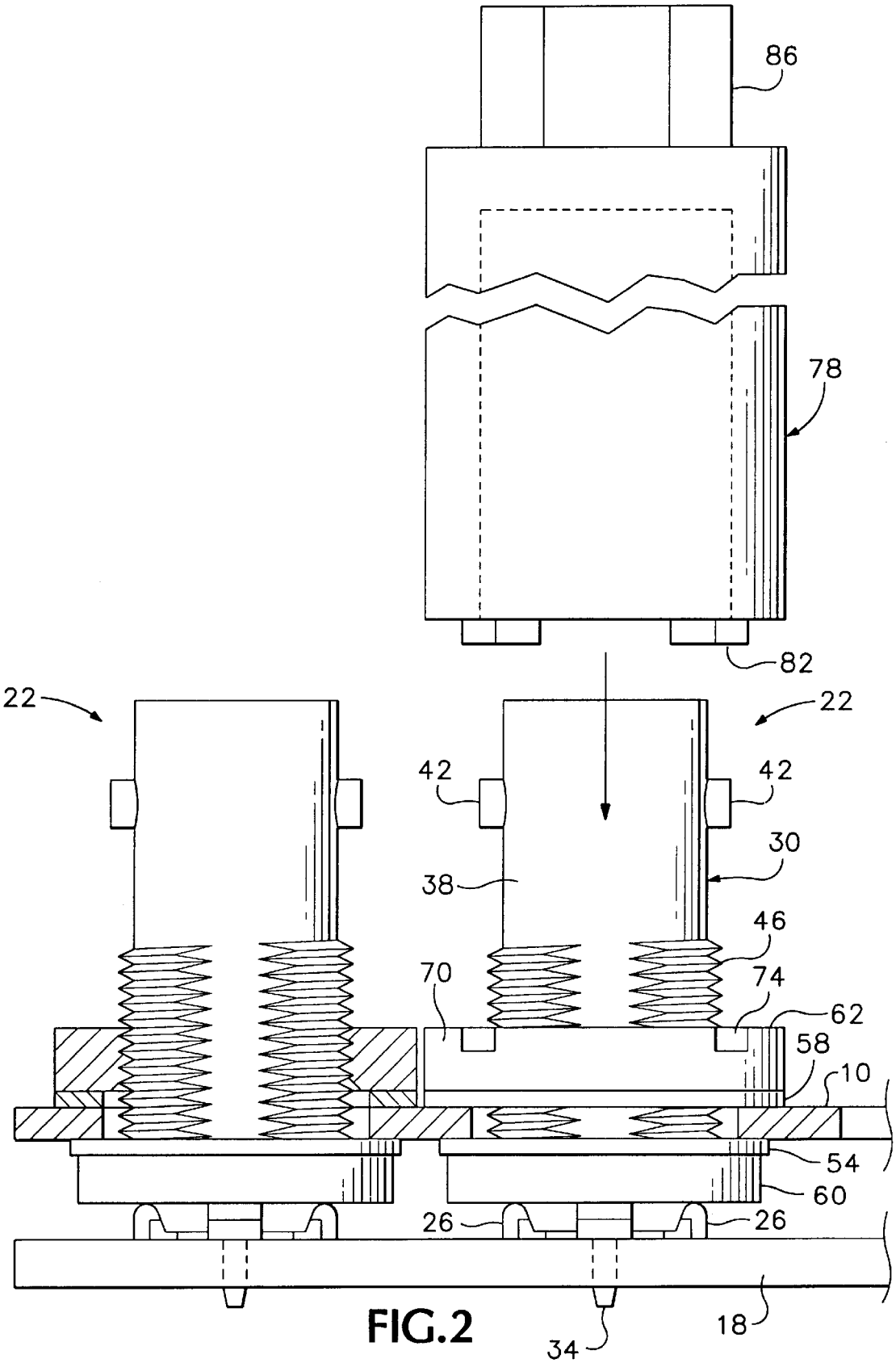
FIG. 2 is a sectional view on the line 2—2 in FIG. 1.

A BNC receptacle 22 is fitted in each of the openings. The BNC receptacle has connection lugs 26 (FIG. 2) that are electrically connected to the barrel 30 of the receptacle and are electrically connected to a ground plane conductor of the PCB backplane. Each receptacle also includes a signal conductor 34, which is electrically connected to a signal trace of the backplane.

The barrel of the BNC receptacle includes an axially outer portion 38 having a generally smooth exterior surface, except for bayonet pins 42, and an axially inner portion 46 provided with an external screw thread. The barrel also includes a flange 60 that is axially inward of the inner portion 46, such that the inner portion 46 is between the outer portion 38 and the flange 60.

The inner portion 46 of the barrel has flats at its periphery and the opening 14 is of correspondingly non-circular form. Accordingly, the receptacle is held against rotation in the opening.

An inner washer 54 is fitted over the barrel and lies between the flange 60 and the back plate 10. An outer washer 58 is fitted over the barrel and lies against the metal back plate. A nut 62 is in threaded engagement with the inner portion 46 of the barrel 30 such that washers 54 and 58 and the plate 10 are clamped between the nut 62 and the flange 60. In this manner, the barrel 30 is held securely to the plate 10 and under normal circumstances no significant stress is applied to the solder connections to the PCB 18.

The threaded portion 46 of the barrel 30 is only slightly greater in diameter than the unthreaded portion 38 and the tip-to-tip dimension of the bayonet pins 42 is greater than the external diameter of the inner portion 46, and accordingly the nut 62 has internal cutouts 66 to clear the bayonet pins 42.

The nut 62 has a cylindrical external surface 70. i.e. it is circular in cross-section. Therefore, the nut 62 does not interfere with the nuts used to retain neighboring barrels as long as the diameter of the nut is less than the center-to-center spacing of the barrels. In practice, the nominal external diameter of the nut can be as little as 0.61 inches (15.494 mm), which allows the barrels to be placed at a center-to-center spacing of 0.625 inches.

Since the external surface of the nut is cylindrical, the nut cannot be driven using a standard socket or wrench designed for driving a hexagonal nut. The nut has a key formation on one of its axial end faces. The key formation includes four equiangularly distributed radial recesses or slots 74. At its opposite axial end, the bore of the nut is chamfered. The nut is installed using a tool 78 of internal diameter slightly greater than the tip-to-tip dimension of the bayonet pins 42 and of external diameter equal to the external diameter of the nut 62. At one end, the tool 78 is provided with four equiangularly distributed radial projections or bits 82, for engaging the four slots 74 respectively of the nut, and at its opposite end is provided with a hexagonal nut 86 which can be engaged by a standard hexagonal socket or wrench.

To install the nut 62, the equipment is oriented with the metal back plate substantially horizontal and the barrels 30 projecting upwards from the plate. The nut is fitted by hand over the outer portion 38 of the barrel 30 and is turned about the central axis of the barrel to position the cutouts 66 over the bayonet pins 42 respectively. The nut then falls down the barrel and the chamfer centers the nut on the threaded portion of the barrel and ensures that the nut lies perpendicular to the central axis of the barrel. The tool 78 is then placed over the barrel 30 and is turned so that the four bits 82 engage the slots 74 of the nut 62. The tool is then turned in the clockwise direction, turning the nut, and the thread of the nut engages the thread of the barrel. Because the nut is centered on the threaded portion of the barrel and lies perpendicular to the central axis, there is no need to finger start the threads and there is little danger of cross threading. Turning the tool drives the nut 62 onto the thread of the barrel 30 and into engagement with the washer 58, thereby clamping the barrel 30 to the plate 10.

It will be appreciated that the invention is not restricted to the particular embodiment that has been described, and that variations may be made therein without departing from the scope of the invention as defined in the appended claims and equivalents thereof. For example, the invention is not restricted to the specific key formation that has been described and illustrated and other key formations may be used instead. The invention is not restricted to the outer peripheral surface of the nut being cylindrical, since the space requirements for installing even a hexagonal nut are reduced if the key formation is provided on an end face of the nut. The invention is not restricted to the circuit board being perpendicular to the central axes of the BNC receptacles, and is also applicable to the so-called front mounting style of receptacle, which is configured for mounting to a circuit board that is parallel to the central axis of the receptacle. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated.

What is claimed is:

1. A coaxial connector assembly for mounting in an aperture in a stiff plate, said connector assembly including:

a barrel having a forward end for receiving a mating connector, a flange at a rear end of the barrel for engaging an interior surface of a mounting plate, and an external screw thread intermediate a front and rear ends of the barrel, and a nut which can be fitted on the barrel from the forward end thereof and has an internal screw thread for threaded engagement with the external screw thread of the barrel, and wherein the nut has an end face which is parallel to the flange and the end face has a key formation for engagement by a driving tool.

2. A connector assembly according to claim 1, wherein the nut has a cylindrical peripheral surface.

3. A connector assembly according to claim 1, wherein the key formation includes at least two radial slots.

4. A connector assembly according to claim 1, wherein the key formation includes four equiangularly distributed radial slots.

5. A connector assembly according to claim 1, wherein the nut has an internal chamfer for positioning the nut on the external screw thread of the barrel.

* * * * *